United States Patent [19]

Eastman

[11] 4,274,479

[45] Jun. 23, 1981

[54] SINTERED GROOVED WICKS

[75] Inventor: George Y. Eastman, Lancaster, Pa.

[73] Assignee: Thermacore, Inc., Lancaster, Pa.

[21] Appl. No.: 944,541

[22] Filed: Sep. 21, 1978

[51] Int. Cl.[3] ..... F28D 15/00

[52] U.S. Cl. ..... 165/104.26; 29/157.3 R; 122/366

[58] Field of Search ..... 165/105; 122/366

[56] References Cited

U.S. PATENT DOCUMENTS

| | | | |
|---|---|---|---|
| 3,537,514 | 11/1970 | Levedahl | 165/105 |
| 3,613,778 | 10/1971 | Feldman, Jr. | 165/105 |
| 3,675,711 | 7/1972 | Billinsbi et al. | 165/105 X |
| 3,681,843 | 8/1972 | Arcella et al. | 165/105 X |
| 3,788,388 | 1/1974 | Barbmann | 165/105 X |

OTHER PUBLICATIONS

Basiulis et al., *A Designers Guide to Heat Pipes,* Design News, pp. 159, 162, 3/18/1974.

*Primary Examiner*—Albert W. Davis
*Attorney, Agent, or Firm*—Martin Fruitman

[57] ABSTRACT

A heat pipe capillary wick constructed from a sintered metal cylinder formed in close contact with the inner diameter of the heat pipe casing, and containing longitudinal grooves on the wick's inner surface, adjacent to the vapor space. The grooves provide longitudinal capillary pumping while the high capillary pressure of the sintered wick provides liquid to fill the grooves and assure effective circumferential distribution of liquid in the heat pipe.

5 Claims, 8 Drawing Figures

SINTERED GROOVED WICKS

BACKGROUND OF THE INVENTION

The present invention relates generally to a heat transfer device and more specifically to the structure and method of constructing a sintered heat pipe wick with longitudinal grooves adjacent to the vapor space. Heat pipes with longitudinal grooves lining the inside of the casing, in effect making part of the casing act as a wick, have been known previously. In various versions, these devices have been used either with the grooves uncovered or covered with fine mesh screen. Covered grooved casings provided the highest heat transfer rates reported to date. Uncovered grooves in the casing are also used in heat pipes for the thermal control of spacecraft.

In describing grooved structures it is customary to speak of "lands" and grooves or channels. The lands are the material between the grooves or channels. The sides of the lands define the width of the grooves. Thus, the land height is also the groove depth. The prior art consists of grooved structures in which the lands are solid material, integral with the casing wall. The grooves are made by various machining, chemical milling or extrusion processes.

The grooves are generally of rectangular crossection. However, other shapes more complex have been made and tested. Complex groove structures are quite difficult and costly to fabricate, but have certain performance advantages. The capillary pressure providing flow in a grooved casing heat pipe is determined by the groove width, with narrower grooves providing higher pumping pressures. If the groove is of rectangular crossection, a narrow width will produce a high viscous drag as compared with a groove of the same crossectional area have equal depth and width. These complex crossections are used to provide relatively high capillary pressure and relatively low liquid drag.

In addition to their function in defining the capillary pressure and liquid drag, the lands are thought to play two important roles in the thermal performance of a heat pipe. First, the high thermal conductivity of metallic lands provides the major path for heat to flow to the liquid surface in the evaporator and from the liquid surface in the condenser. This aspect of performance is particularly important with non-metallic working fluids which have relatively poor thermal conductivity. Second, it is believed that thin film evaporation and condensation takes place on the tips of the lands. For this action to be effective the liquid must wet the lands well and there must be a continuous layer of fluid connecting the land tips with its reservoir of liquid in the grooves. However, the reliability and continuity of this layer is doubtful and subject to unpredictable variations. The result may be a large variation in the effective area of the evaporator and condenser, and a major variation in heat pipe performance.

Grooved casing heat pipes provide excellent longitudinal passages for liquid flow, but effectively block circumferential flow. Thus, if either the evaporation or condensation processes are circumferentially non-uniform, as is usually the case to some degree, the liquid returning from the condenser is unlikely to be distributed circumferentially in the same manner as the evaporation rate in the evaporator. This unbalance can cause dryout of some grooves while others are carrying excess liquid. A means of circumferential liquid distribution is required. This has previously been accomplished by interconnecting the grooves in the condenser or by covering the grooves with fine pore mesh screen. Both of these methods, however, represent added costs and complexity.

Wicks made from sintered metal powder are also known. However, these are generally simple homogeneous structures of annular crossection.

SUMMARY OF THE INVENTION

It is the object of the present invention to furnish a grooved wick structure for heat pipes which effectively distributes liquid circumferentially around the heat pipe and also assures liquid filling of the grooves.

It is a further object of the present invention to provide a grooved wick heat pipe which effectively utilizes the lands of the grooves as well as the grooves themselves as evaporation and condensation surfaces.

It is a still further object of this invention to furnish a grooved wick heat pipe which is easily and economically produced regardless of the material of the casing.

These objects are accomplished by the use of a sintered wick formed onto the inside surface of the heat pipe casing. The wick is constructed with multiple longitudinal grooves adjacent to the central opening which operates as the heat pipe vapor space.

The grooves may be made in any desired crossectional configuration but for grooves with widths increasing with radial distance from the center of the heat pipe or grooves whose heights are greater than their widths, the groove must be closed or "dammed" with sintered powder before approaching the end of the wick. This blocking of the grooves assures that the capillary pumping pressure in the groove is determined by its narrowest width at the vapor liquid interface.

DETAILED DESCRIPTION OF THE PREFERRED EMBODIMENTS

Figure 1:
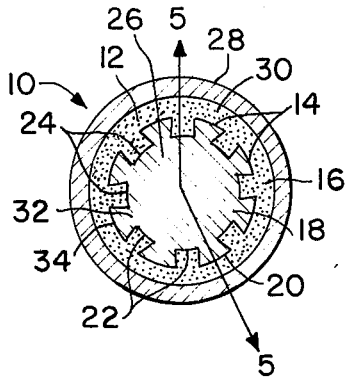
FIG. 1 is a crossectional view transverse to the axis of a heat pipe which contains the sintered grooved wick, shown during the process of forming the wick by casting.

FIG. 1 shows the structure of heat pipe 10 in a crossectional view transverse to the axis of the heat pipe casing as wick 12 is being formed by one method of construction. Longitudinal grooves 14 are formed from powder 16 sintered in place around shaped mandrel 18 to form wick 12. Lands 20 of the mandrel form grooves 14 of the finished wick and grooves 22 of mandrel 18 form the lands 24 of wick 12. Solid core 26 of mandrel 18 determines the configuration of the vapor space of heat pipe 10.

Figure 5:
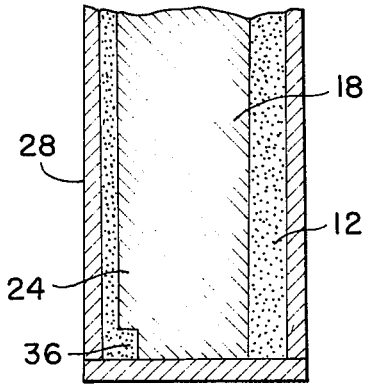
FIG. 5 is a partial longitudinal crossectional view of a closed-end grooved wick structure taken on section line 5—5 of FIG. 1.

Mandrel 18 is constructed of a material to which the powder will not stick during sintering. Examples are oxidized stainless steel or ceramics. Mandrel 18 is centered within outer casing 28 which forms the heat pipe vacuum tight enclosure. The assembly is placed in a vertical position, as shown in FIG. 5, and powder 16 to be sintered is poured into the space between mandrel 18 and casing 28. The assembly is gently agitated during pouring to assure void-free settling of the powder. When full, the assembly is placed in a furnace and sintered for a time and temperature which will produce the desired density of the sintered material. This process not only bonds together the grains of powder, but bonds powder 16 to the outer casing 28. After firing, mandrel 18 is removed, leaving grooved wick 12 in place. The heat pipe is then completed by processes well known in the art.

Figure 2:
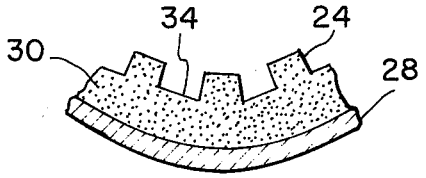
FIG. 2 is a partial crossectional view of an alternate wick configuration of the invention.
Figure 3:
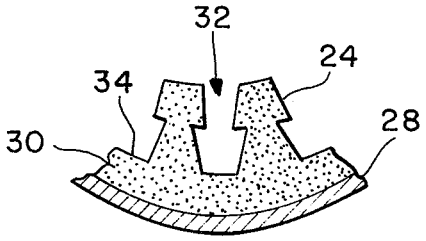
FIG. 3 is a partial crossectional view of another wick configuration.
Figure 4:
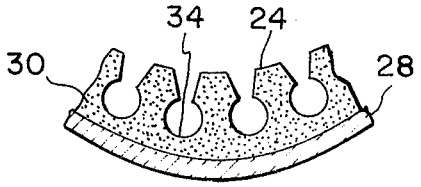
FIG. 4 is a partial crossection view of another wick configuration.

Many wick configurations can be fabricated by means of the central mandrel technique. FIGS. 2, 3 and 4 show several of the usable configurations including the rectangular shape of FIG. 2, the paddle shape of FIG. 3 and keyhole configuration of FIG. 4.

Such grooved wick configurations have several advantages over the prior art which uses grooves in the casing. First, the high cost of making the grooves is invested in the mandrel, which is reusable, rather than in machining of the individual heat pipe casings. The mandrel cost can be amortized over large numbers of heat pipes, thereby reducing the unit cost of the heat pipes.

Second, the process is applicable to materials very difficult to machine, such molybdenum, tungsten or ceramics and also applicable to materials difficult to extrude, such as stainless steels or super alloys.

Third, by leaving a band of porous sintered material 30 around the inner circumference of outer shell 28, circumferential distribution of liquid is automatically accomplished by the capillary pumping action of the pores.

Fourth, the small pores of the sintered porous matrix in lands 24 of wick 12 provide very high capillary pressures which assure good distribution across the entire surface of the lands in the heat pipe evaporator section. The true evaporation area is thus accurately established, making performance reproducible and predictable. In the condenser section, the porous lands absorb liquid as it condenses and deliver it to the liquid in the grooves. Thus the condenser area also is well established, and, furthermore, liquid films of excessive thicknesses do not accumulate on the land tips.

Finally, the high capillary pressure of the small pores in the sintered powder also help assure filling of the grooves by providing high capillarity along the side walls of the grooves.

In those variations of the invention in which the groove width at the neck 32, at the liquid to vapor interface, is less than the groove width at its base 34 or the groove depth, as in the structures of FIGS. 1, 3 and 4, the ends of the grooves must contain orifices no larger than the width of the groove at the liquid vapor interface. Otherwise, the capillary pressure in the groove may be determined by the longest groove dimension rather than the intended narrow neck 32. In these cases, the most advantageous method of ending the grooves is to end the lands of the mandrel a short distance before the evaporator end of the heat pipe. As shown in FIG. 5, a crossection view taken on line 5—5 of FIG. 1, the space 36 beyond the end of the mandrel lands 24 then naturally fills with powder during filling of the space between the mandrel 18 and outer casing 28. The heat pipe wick grooves then end in the small pore sintered powder, which guarantees high capillary for wick 12.

One embodiment of the invention is a heat pipe formed of an oxygen-free copper shell one-half inch in diameter and 24 inches long with a wall 1/32 inch thick. An oxidized stainless steel mandrel $\frac{3}{8}$ inch in diameter with 12 grooves 0.05 inch deep and approximately 0.05 inch wide is centered within the outer shell, and the spaces between the mandrel and outer shell are filled with fine copper powder such as AMAX Type B powder. The assembly is then fired in an atmosphere of humidified hydrogen for one hour at 900° centigrade. The mandrel is removed, leaving a grooved wick consisting of copper powder sintered to approximately 48% of the theoretical density. The heat pipe ends are then closed, the working fluid inserted and the heat pipe vacuum processed and sealed by means well known in the art.

Figure 6:
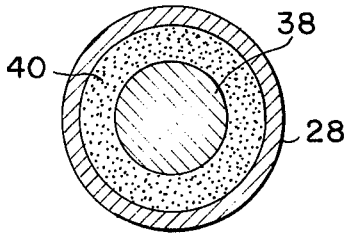
FIG. 6 is a crossection view of the first step in producing a grooved wick by broaching the grooves.

An alternate process for making the sintered grooved wick heat pipe derives from the ease with which partially sintered powder can be machined and cut. As shown in FIG. 6, in this process, mandrel 38 without lands and grooves is used to form simple inner cylinder 40 of powder bonded to the inside circumference of casing 28 just as in the previously discussed process. This assembly is not kept in the furnace for sufficient time to fully harden, but is, instead, removed from the furnace soon after the sintering process has begun.

In this state, the sintered powder is rigid enough to support itself within casing 28 in cylindrical shape 40 as central mandrel 38 is removed, but cylinder 40 is still soft enough to be easily machined.

Figure 7:
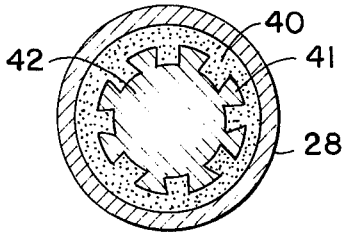
FIG. 7 is a crossectional view of the grooved wick during the broaching operation.

With the assembly out of the furnace, mandrel 38 is extracted from the assembly and, as shown in FIG. 7, broach 42 is used to cut grooves 41 into the inside surface of sintered cylinder 40 for the desired length. Once the grooves are cut, the assembly is replaced into the furnace and the sintering process is continued for a time appropriate to yield the desired density, and the heat pipe is later assembled and completed as with the previous method of fabrication.

Figure 8:
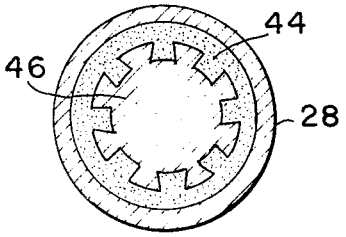
FIG. 8 is a crossectional view transverse to the axis of a grooved wick as it is formed by extrusion.

Another method of construction of the invention is shown in FIG. 8. FIG. 8 is a crossectional view transverse to the heat pipe axis as a grooved sintered wick is being formed by extrusion. Highly viscous paste 44 is extruded in place between casing 28 and nozzle core 46, thus forming a grooved wick structure which is capable of retaining its shape during the subsequent firing operation until the sintering operation is complete. The heat pipe is then completed as before.

It is to be understood that the forms of this invention as shown are merely preferred embodiments. Various changes may be made in the function and arrangement of parts; equivalent means may be substituted for those illustrated and described; and certain features may be used independently from others without departing from the spirit and scope of the invention as defined in the following claims.

What is claimed as new and desired to be secured by Letters Patent of the United States is:

1. A heat pipe comprising:

an outer casing means forming a vacuum tight enclosure; and a wick means constructed from sintered material in intimate surface contact with the inner surface of the casing means, said wick means containing at least one longitudinal capillary groove located on the surface of the wick means adjacent to an open volume intended as the heat pipe vapor space and designed to provide longitudinal capillary pumping of the liquid.

2. A heat pipe as in claim 1 wherein the grooves are formed with neck widths smaller than base widths, and the ends of the grooves terminate before reaching the ends of the heat pipe.

3. A heat pipe as in claim 1 wherein the sintered material is metal powder.

4. A heat pipe as in claim 1 wherein the sintered material is ceramic powder.

5. A heat pipe as in claim 1 wherein the sintered material forms a continuous layer around the inner surface of the heat pipe casing between the grooves and the casing to provide circumferential liquid circulation within the wick.

* * * * *